US010617229B1

(12) United States Patent
Stafford et al.

(10) Patent No.: US 10,617,229 B1
(45) Date of Patent: Apr. 14, 2020

(54) SHELF ASSEMBLY WITH POWERED BACK PANELS

(71) Applicant: Target Brands, Inc., Minneapolis, MN (US)

(72) Inventors: William Y. Stafford, Minnetrista, MN (US); Jennifer A. Theisen, Crystal, MN (US); Stanley J. Valiulis, Rockford, IL (US); Somsay Rimpakone, Rockford, IL (US); Gabriel Garduno, Minneapolis, MN (US); Nicholas C. Juric, Rockford, IL (US); David Schultz, Rockford, IL (US)

(73) Assignee: Target Brands, Inc., Minneapolis, MN (US)

( * ) Notice: Subject to any disclaimer, the term of this patent is extended or adjusted under 35 U.S.C. 154(b) by 14 days.

(21) Appl. No.: 16/161,735

(22) Filed: Oct. 16, 2018

(51) Int. Cl.

| | |
|---|---|
| ***A47F 3/00*** | (2006.01) |
| ***F21V 19/00*** | (2006.01) |
| ***A47F 5/00*** | (2006.01) |
| ***A47F 5/10*** | (2006.01) |
| ***A47B 96/06*** | (2006.01) |
| ***F21V 23/06*** | (2006.01) |

(52) U.S. Cl.
CPC ..... *A47F 3/001* (2013.01); *A47B 96/061* (2013.01); *A47F 5/005* (2013.01); *A47F 5/103* (2013.01); *F21V 19/003* (2013.01); *F21V 23/06* (2013.01)

(58) Field of Classification Search
CPC ..... F21V 19/003; F21V 23/06; A47F 3/001; A47F 5/005; A47F 5/103; A47B 96/061
See application file for complete search history.

(56) References Cited

U.S. PATENT DOCUMENTS

| | | | |
|---|---|---|---|
| 1,814,091 | A | 7/1931 | Mically |
| 2,405,416 | A | 8/1946 | Foulkes |
| 3,677,202 | A | 7/1972 | Young |
| 5,353,714 | A | 10/1994 | Hardy |
| 5,497,888 | A | 3/1996 | Michaels et al. |
| 6,231,205 | B1 | 5/2001 | Slesinger et al. |
| 6,520,355 | B1 | 2/2003 | Pritchard et al. |
| 6,739,463 | B2 | 5/2004 | Wishart et al. |
| 7,175,034 | B2 | 2/2007 | Nook et al. |
| 7,367,460 | B2 | 5/2008 | Hirsch |
| 7,478,732 | B2 | 1/2009 | Brownfield et al. |
| 7,954,648 | B2 | 6/2011 | Takashima et al. |

(Continued)

*Primary Examiner* — Anabel Ton
(74) *Attorney, Agent, or Firm* — Leanne Taveggia Farrell; Westman, Champlin & Koehler, P.A.

(57) ABSTRACT

A shelf assembly includes a plurality of fins, a plurality of powered back panels and a plurality of shelves. Each powered back panel has a pair of conductive uprights that are vertically oriented and horizontally spaced apart, is located between two of the plurality of fins and is electrically coupled to another of the plurality of powered back panels. Each shelf is mounted to and electrically coupled to the pair of conductive uprights of the powered back panel and is configured to power a plurality of lights located on the shelf based on the electrical coupling of each shelf to the pair of conductive uprights. Two of the plurality of shelves mounted to the same powered back panel and two of the plurality of fins located on either side of that same powered back panel are configured to form a cuboid with an open front to display merchandise.

20 Claims, 11 Drawing Sheets

(56) References Cited

U.S. PATENT DOCUMENTS

| | | | | |
|---|---|---|---|---|
| 8,646,935 | B2 | 2/2014 | Karan | |
| 8,925,745 | B2 | 1/2015 | Theisen et al. | |
| 8,979,296 | B2 * | 3/2015 | Wiemer | A47F 5/103 362/125 |
| 9,204,736 | B2 | 12/2015 | Lindblom et al. | |
| 9,228,735 | B2 | 1/2016 | Liu | |
| 9,364,100 | B2 | 6/2016 | Browning et al. | |
| 9,404,645 | B1 * | 8/2016 | Feng | F21V 23/001 |
| 9,596,950 | B2 | 3/2017 | Waalkes et al. | |
| 9,629,481 | B2 | 4/2017 | Karan | |
| 2011/0058357 | A1 * | 3/2011 | Anderson | A47F 3/001 362/125 |
| 2011/0204009 | A1 * | 8/2011 | Karan | A47F 1/12 211/59.2 |
| 2011/0273867 | A1 | 11/2011 | Horst et al. | |
| 2014/0055987 | A1 * | 2/2014 | Lindblom | A47F 3/001 362/125 |
| 2014/0268691 | A1 | 9/2014 | Hinkle | |
| 2016/0135613 | A1 | 5/2016 | Jones et al. | |
| 2017/0172315 | A1 * | 6/2017 | Hay | A47F 1/126 |
| 2018/0027992 | A1 * | 2/2018 | Schiffman | A47F 3/0478 |
| 2018/0314001 | A1 * | 11/2018 | Veenstra | G09F 13/04 |
| 2019/0298083 | A1 * | 10/2019 | Lee | A47B 96/021 |

* cited by examiner

SHELF ASSEMBLY WITH POWERED BACK PANELS

BACKGROUND

Retail stores use a variety of display fixtures to present products to customers for purchase. These display fixtures can support the product, indicate the product price and include signage, graphics and lighting for highlighting the product. Exemplary display structures include gondolas that support shelves, trays, racks, peg hooks and other similar structures.

The discussion above is merely provided for general background information and is not intended to be used as an aid in determining the scope of the claimed subject matter.

SUMMARY

A shelf assembly includes a plurality of fins, a plurality of powered back panels and a plurality of shelves. Each powered back panel has a pair of conductive uprights that are vertically oriented and horizontally spaced apart from each other. Each powered back panel is located between two of the plurality of fins and is electrically coupled to another of the plurality of powered back panels. Each of the plurality of shelves is mounted to and electrically coupled to the pair of conductive uprights of one of the powered back panels and configured to power a plurality of lights located on the shelf based on the electrical coupling of each shelf with the pair of conductive uprights. Two of the plurality of shelves mounted to the same pair of conductive uprights of the same powered back panel and two of the plurality of fins located on either side of that same powered back panel are configured to form a cuboid with an open front to display merchandise.

A shelf assembly includes at least one cross bar configured to be mounted to a pair of uprights on a gondola. The shelf assembly further includes a first fin mounted to the at least one cross bar, a first powered back panel mounted to the at least one cross bar and located adjacent to the first fin and a second fin mounted to the at least one cross bar and located adjacent to the first powered back panel on an opposing side of the first powered back panel from the location of the first fin. The first powered back panel has a first pair of conductive uprights that are vertically oriented and horizontally spaced apart from each other. At least two shelves are mounted to and electrically coupled to the first pair of conductive uprights of the first powered back panel, are vertically spaced apart from each other along the first pair of conductive uprights and are configured to power a plurality of lights located on the at least two shelves based on the electrical coupling of the at least two shelves to the first pair of conductive uprights. The first fin, the first powered back panel, the second fin and the at least two shelves that are mounted to the first powered back panel are configured to form a cuboid with an open front to display merchandise.

A method of assembling a shelf assembly includes mounting at least one cross bar to a pair of uprights on a gondola, mounting a first fin to the at least one cross bar, mounting a first powered back panel to the at least one cross bar and locating the first powered back panel adjacent to the first fin and mounting a second fin to the at least one cross bar and locating the first powered back panel adjacent to an opposing side of the first powered back panel from the location of the first fin. The first powered back panel has a first pair of conductive uprights that are vertically oriented and horizontally spaced apart from each other. At least two shelves are mounted and electrically coupled to the first pair of conductive uprights of the first powered back panel by vertically spacing each along the first pair of conductive uprights and powering a plurality of lights located on the at least two shelves based on the electrical coupling of the at least two shelve to the first pair of conductive uprights. The first fin, the first powered back panel, the second fin and the at least two shelves mounted to the first powered back panel are configured to form a cuboid with an open front to display merchandise.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

A gondola is a retail display unit that includes a base deck, a pair of uprights, a back wall located between the pair of uprights and is configured to receive display structures, such as shelves, for supporting and displaying merchandise. A shelf assembly mounted to a gondola is described below that allows for powered shelves with lighting to be spaced apart from each other a distance sufficient to position vertical fin panels in between the powered shelves to give a lighted shelf display a cuboid shelf design. In particular, a cuboid shelf design, which would otherwise include unlit cuboids are lit with illumination to better show and display merchandise being offered for sale.

Cuboid shelf designs are common to the furniture industry and such furniture pieces may be called by various terms including cube organizer, storage cube, cube shelf unit and cubby. In some embodiments, cuboid shelf designs include one or more cuboids in a unit where each cuboid has an open front, two sides that may or may not be shared with other cuboids of the unit, a top that may or may not be shared with the bottom of another cuboid of the unit and a bottom that may or may not be shared with the top of another cuboid of the unit. In some embodiments, the cuboids include a back. The cuboids may have widths, heights and depths that are not all the same, but the cuboids may also have widths, heights and depths that are the same and therefore would be square and geometrically termed a cube.

Figure 1:
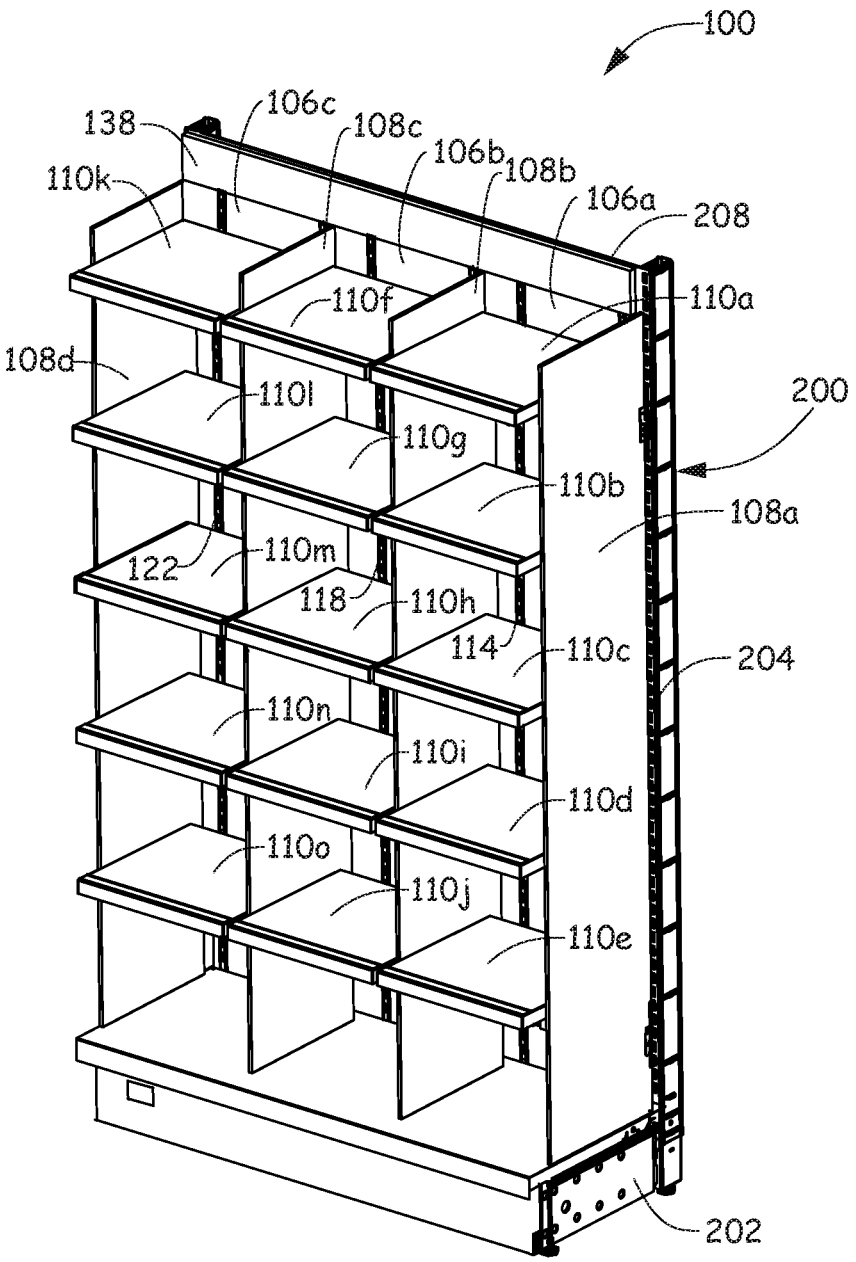
FIG. 1 is a perspective view of a shelf assembly according to an embodiment.
Figure 2:
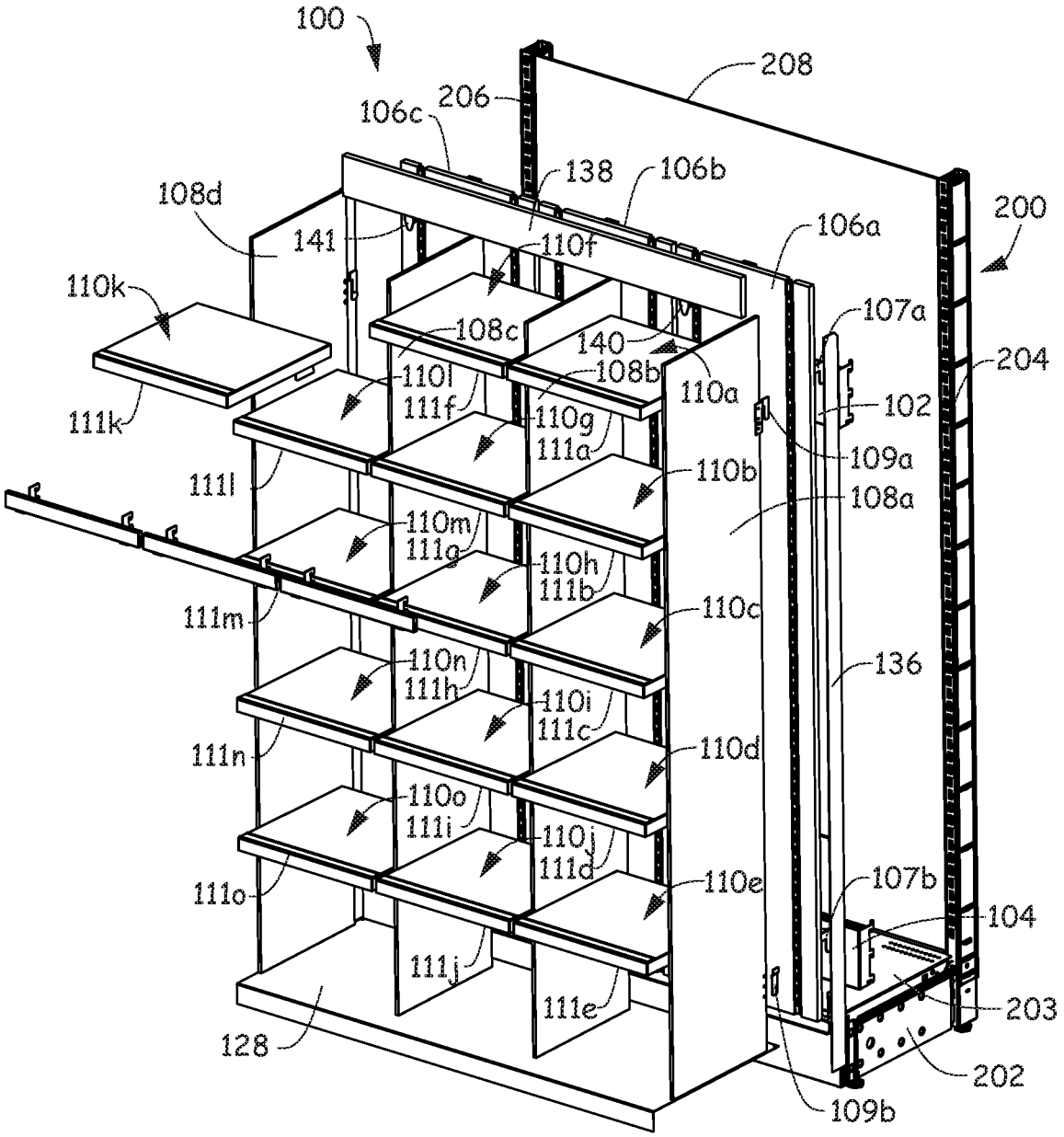
FIG. 2 is an exploded perspective view of the shelf assembly in FIG. 1.
Figure 3:
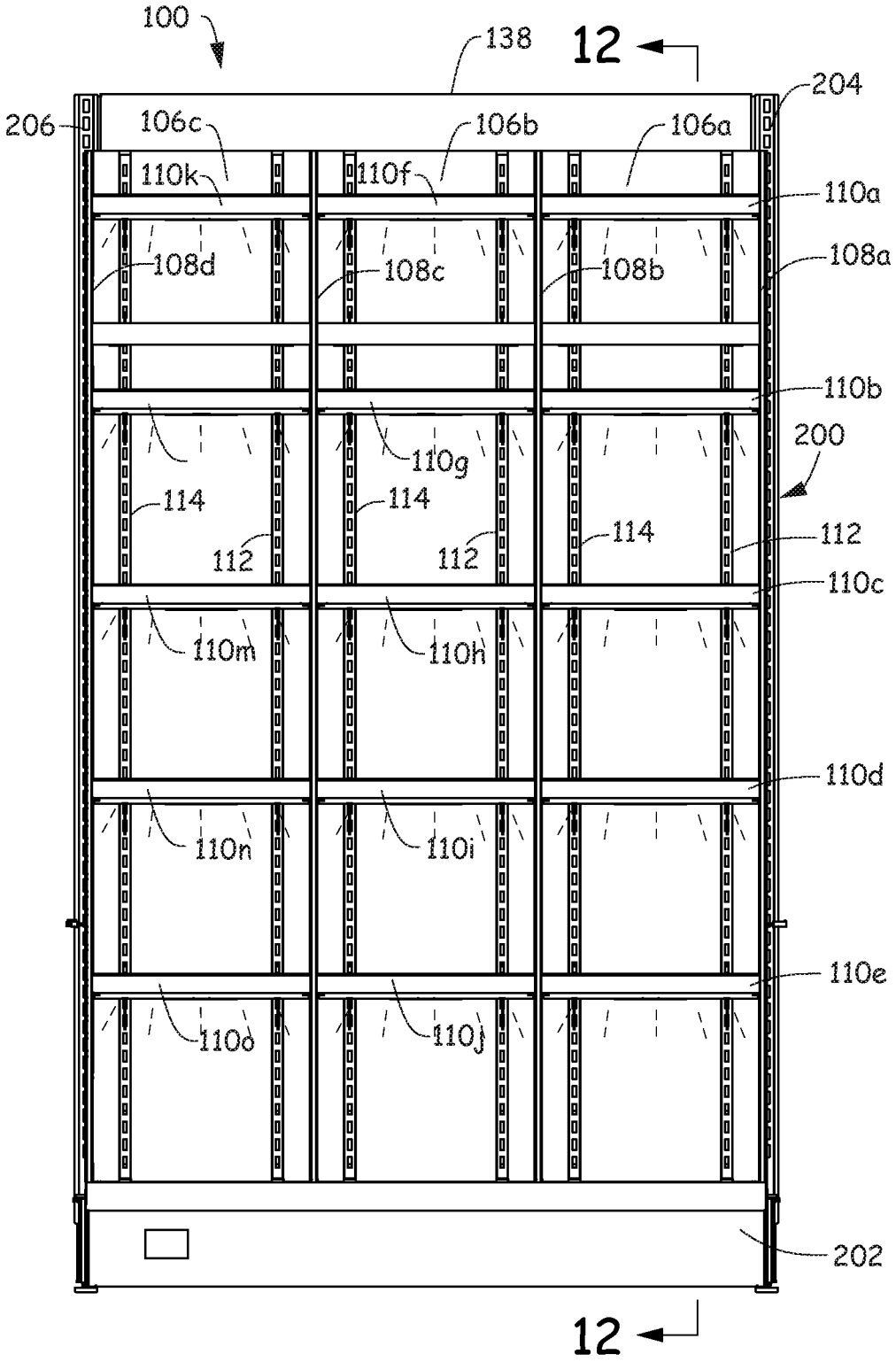
FIG. 3 is a front view of the shelf assembly in FIG. 1.
Figure 4:
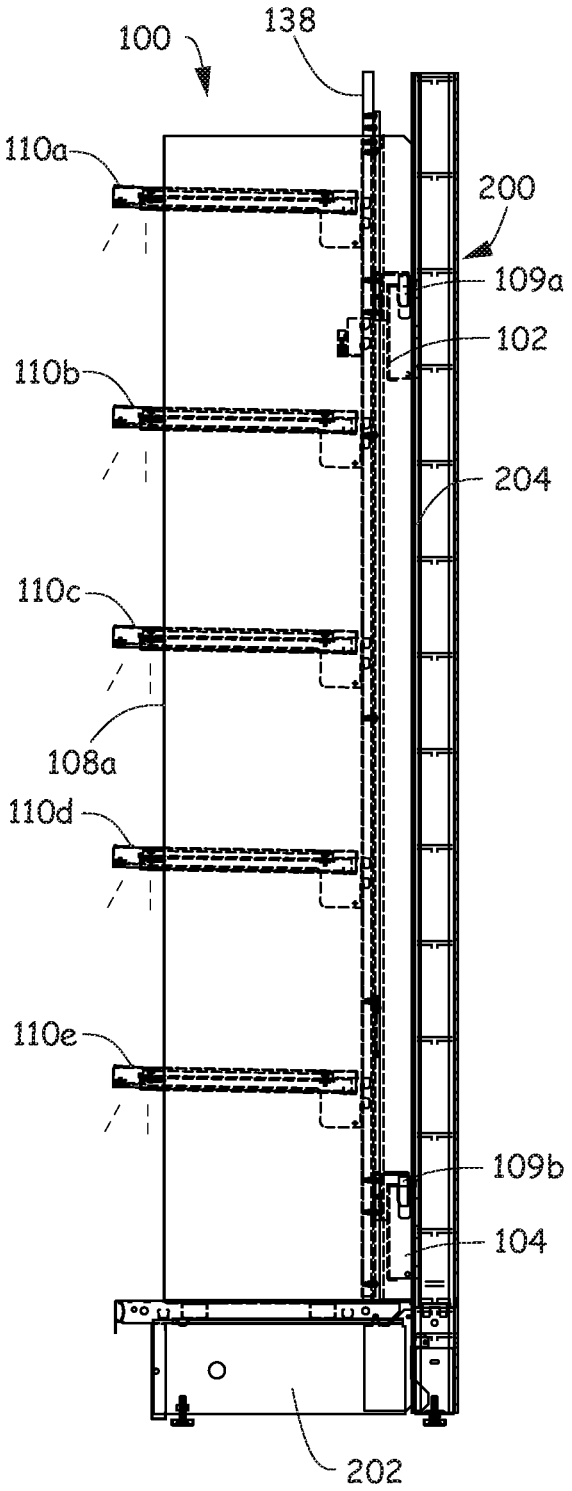
FIG. 4 is a right side view of the shelf assembly in FIG. 1.
Figure 5:
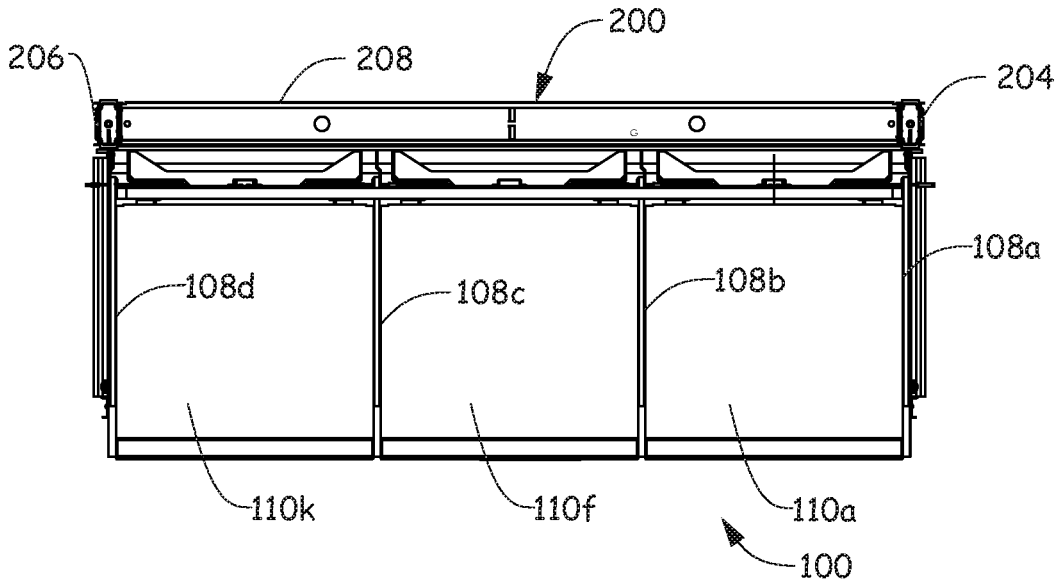
FIG. 5 is a top view of the shelf assembly in FIG. 1.

FIG. 1 is a perspective view of a shelf assembly 100 according to an embodiment. FIG. 2 is an exploded perspective view, FIG. 3 is a front view, FIG. 4 is a right side view, the left side view being a mirror image, and FIG. 5 is a top view of shelf assembly 100. Shelf assembly 100 is mounted to a gondola 200. In FIG. 4, portions of shelves 110*a-e* of shelf assembly 100 that would otherwise be hidden behind fin 108*a* are shown in broken phantom lines. Gondola 200 includes a base deck 202, a pair of uprights 204 and 206 and a back wall 208 located between the pair of uprights 204 and 206. Shelf assembly 100 includes first and second or upper and lower cross bars 102 and 104 configured to mount to the pair of uprights 204 and 206 on gondola 200, a plurality of powered back or upright panels configured to mount to first and second cross bars 102 and 104, a plurality of fins or dividers configured to mount to first and second cross bars 102 and 104 and a plurality of shelves configured to mount to the plurality of powered back panels. First and second cross bars 102 and 104 are vertically spaced apart from each other, are mounted horizontally to the pair of uprights 204 and 206 and are configured to receive and support the plurality of fins and the plurality of powered back panels. In the embodiment illustrated, the plurality of powered back panels include powered back panels 106*a*, 106*b* and 106*c*, the plurality of fins or dividers include fins or dividers 108*a*, 108*b*, 108*c* and 108*d* and the plurality of shelves include shelves 110*a-o*. However, any number of powered back panels, fins or dividers and shelves are possible.

Each powered back panel 106*a*, 106*b* and 106*c* includes a pair of conductive uprights 112 and 114 embedded in or formed integral with each powered back panel 106*a*, 106*b* and 106*c* and are vertically oriented and horizontally spaced apart from each other. The pair of conductive uprights 112 and 114 include corresponding slots. More specifically, conductive upright 112 is located closer to a right side of powered back panels 106*a*, 106*b* and 106*c* than conductive upright 114. Likewise, conductive upright 114 is located closer to a left side of powered back panels 106*a*, 106*b* and 106*c* than conductive upright 112. Each powered back panel 106*a*, 106*b* and 106*c* includes hooks for mounting each powered back panel to first and second cross bars 102 and 104. As illustrated in FIG. 2, each powered back panel 106*a*, 106*b* and 106*c* includes one or more first hooks 107*a* for mounting to first cross bar 102 and one or more second hooks 107*b* for mounting to second cross bar 104. In addition, each powered back panel 106*a*, 106*b*, 106*c* is to be located between two of the plurality of fins 108*a-d* and the plurality of powered back panels 106*a-c* are electrically coupled together such that one of the plurality of back panels 106*a-c* is coupled to another one of the plurality of powered back panels 106*a-c*. In one embodiment, these electrical connections between powered back panels 106*a-c* are made with wires and plugs that thread behind fins 108*a-d*. Such electrical connections between powered back panels 106*a-c* is illustrated in more detail below.

Each fin 108*a-d* is configured to be mounted to first and second cross bars 102 and 104 so that a first fin 108*a* is located and mounted adjacent the right side of first powered back panel 106*a*, a second fin 108*b* is located between powered back panels 106*a* and 106*b*, a third fin 108*c* is located between powered back panels 106*b* and 106*c* and a fourth fin 108*d* is located and mounted adjacent to the left side of third powered back panel 106*c*. Each fin 108*a*, 108*b*, 108*c* and 108*d* includes hooks for mounting each fin to first and second cross bars 102 and 104. As illustrated in FIGS. 2 and 4, each fin 108*a*, 108*b*, 108*c* and 108*d* includes one or more first hooks 109*a* for mounting to first cross bar 102 and one or more second hooks 109*b* for mounting to second cross bar 104.

Each of the shelves 110*a-o* is mounted to and electrically coupled to the pair of conductive uprights 112 and 114 of one of the plurality of powered back panels 106*a*-106*c*. More specifically, each of the shelves 110*a-o* is mounted to and electrically coupled to corresponding slots in the pair of conductive uprights of one of the plurality of powered back panels 106*a-c*. In particular, shelves 110*a-e* are mounted to the pair of conductive uprights 112 and 114 of first powered back panel 106*a*, shelves 110*f-j* are mounted to the pair of conductive uprights 112 and 114 of second powered back panel 106*b* and shelves 110*k*-110*o* are mounted to the pair of conductive uprights 112 and 114 of third powered back panel 106*c*.

Each of the shelves 110*a-o* is also configured to power a plurality of light located on the shelf based on its electrical coupling with the pair of conductive uprights 112 and 114. These plurality of lights are located on an underside 111*a-o* of shelves 110*a-o* and at a front end of each shelf as illustrated by the dashed radiating lines in FIGS. 3 and 4 that represent illumination. Therefore, two of the plurality of shelves mounted to the same pair of conductive uprights 112 and 114 on the same powered back panel and two of the plurality of fins located on either side of that same powered back panel are configured to form a lighted cuboid with an open front to display merchandise. For example, shelf 110*a* and shelf 110*b* are mounted to the same pair of conductive uprights 112 and 114 on the same powered back panel 106*a* and fin 108*a* and fin 108*b* located on either side of the same powered back panel 106*a* are configured to form a lighted cuboid with an open front to display merchandise.

Shelf assembly 100 further includes a base deck sham 128, a pair of trim pieces (of which one 136 is shown in FIG. 2) and a header 138 (FIGS. 1-4). Base deck sham 128 covers the top surface of base deck 202 of gondola 200. Trim pieces 136 are located on each of a right side and a left side of shelf assembly 100 to cover right sides and left sides of the first and second cross bars 102 and 104. Header 138 is configured to mate with top ends of at least one of the plurality of powered back panels 106*a-c* using prongs 140 and 141 (FIG. 2).

Figure 6:
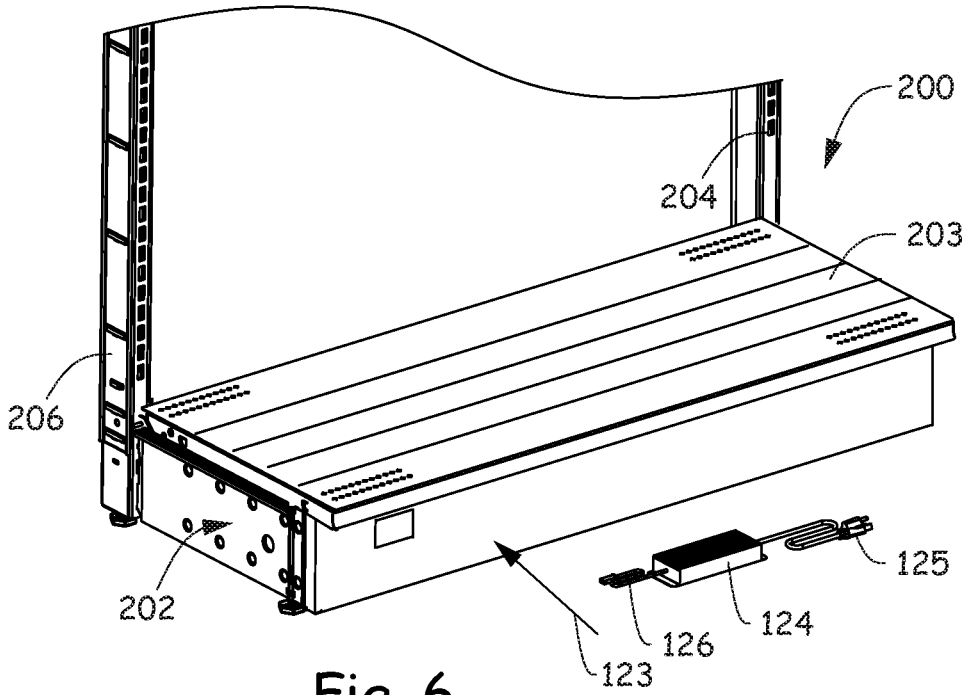
FIG. 6 is a perspective view of a first step in assembling the shelf assembly of FIG. 1.
Figure 7:
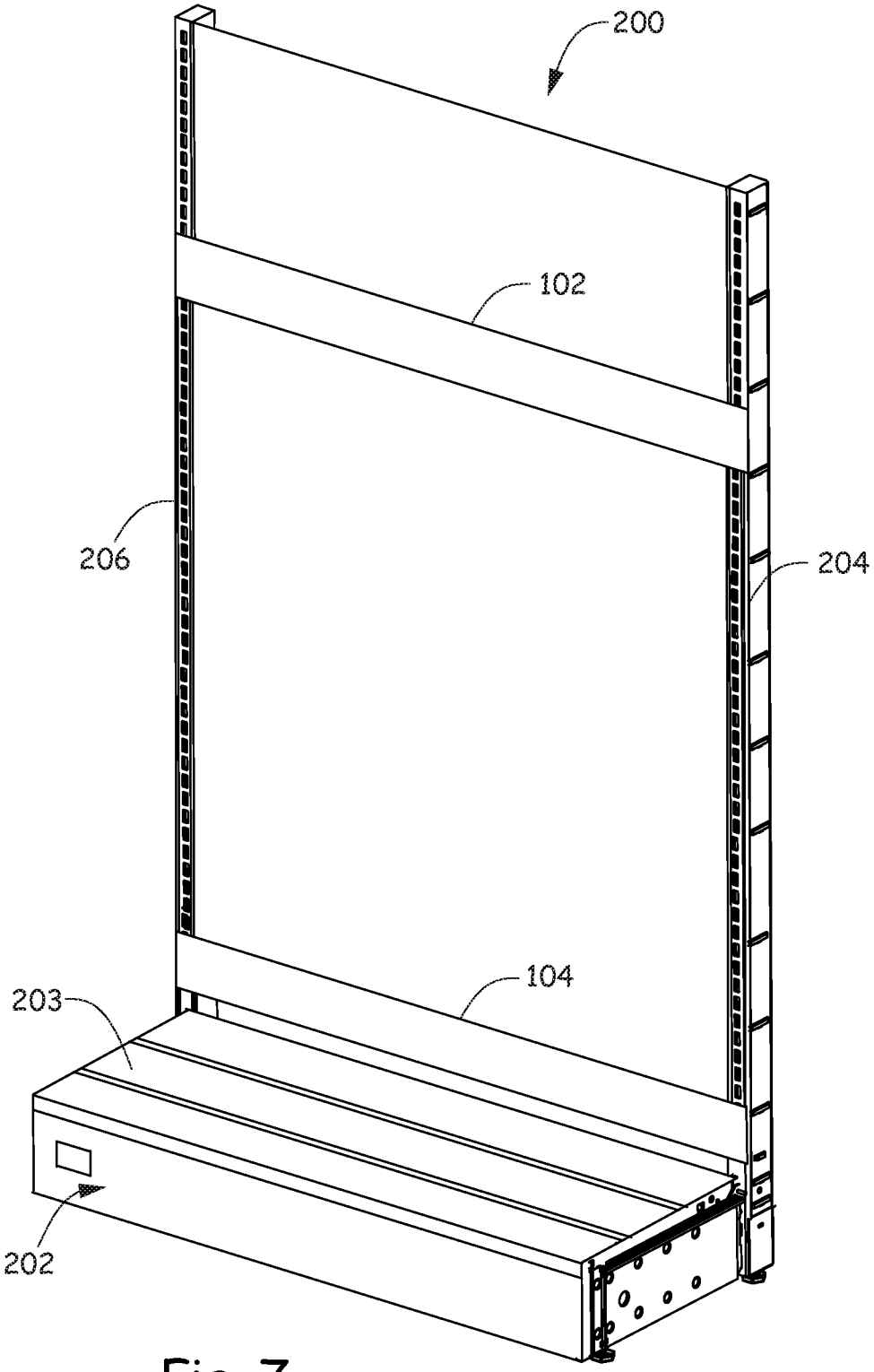
FIG. 7 is a perspective view of a second step in assembling the shelf assembly of FIG. 1.

FIGS. 6-12 illustrate, under one embodiment, steps in assembling shelf assembly 100. It should be realized that other methods than the methods illustrated may be used to assemble shelf assembly 100. In FIG. 6, a power supply 124 is placed under base deck 202 (as indicated by the direction arrow 123), an AC plug 125 of power supply 124 is plugged into an appropriate socket and a DC cord 126 of power supply 124 is pulled up behind base deck cover 203 as far to the left as possible. In FIG. 7, first and second cross bars 102 and 104 are mounted to uprights 204 and 206 of gondola 200 and vertically spaced apart. As illustrated, first cross bar 102 is mounted to slots in uprights 204 and 206 that are closer to a top of uprights 204 and 206 than a bottom of uprights 204 and 206. Second cross bar 104 is mounted to slots in uprights 204 and 206 that are closer to the bottom of uprights 204 and 206 than the top of uprights 204 and 206.

Both cross bars 102 and 104 are mounted in corresponding slots in each of uprights 204 and 206 so that cross bars 102 and 104 are level.

Figure 8:
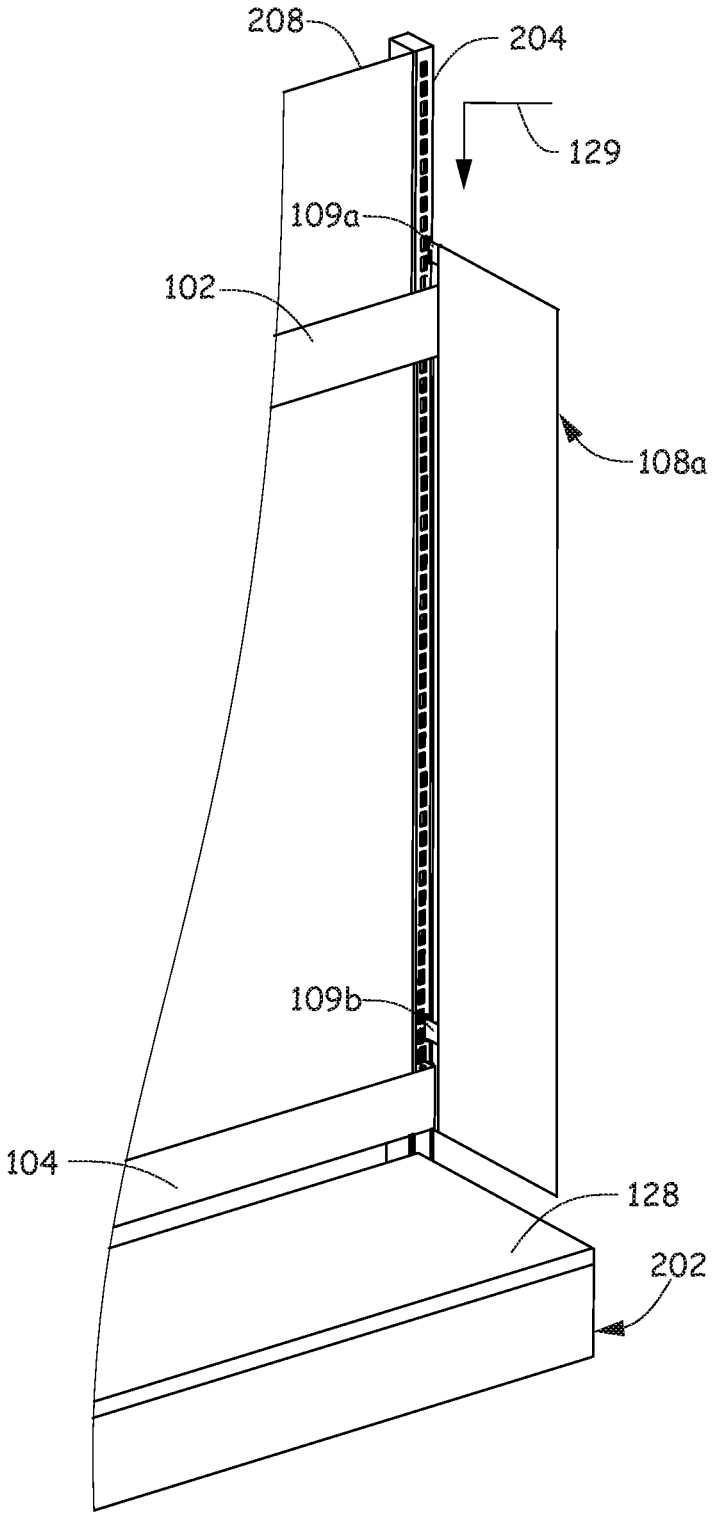
FIG. 8 is a perspective view of a third step in assembling the shelf assembly of FIG. 1.
Figure 9:
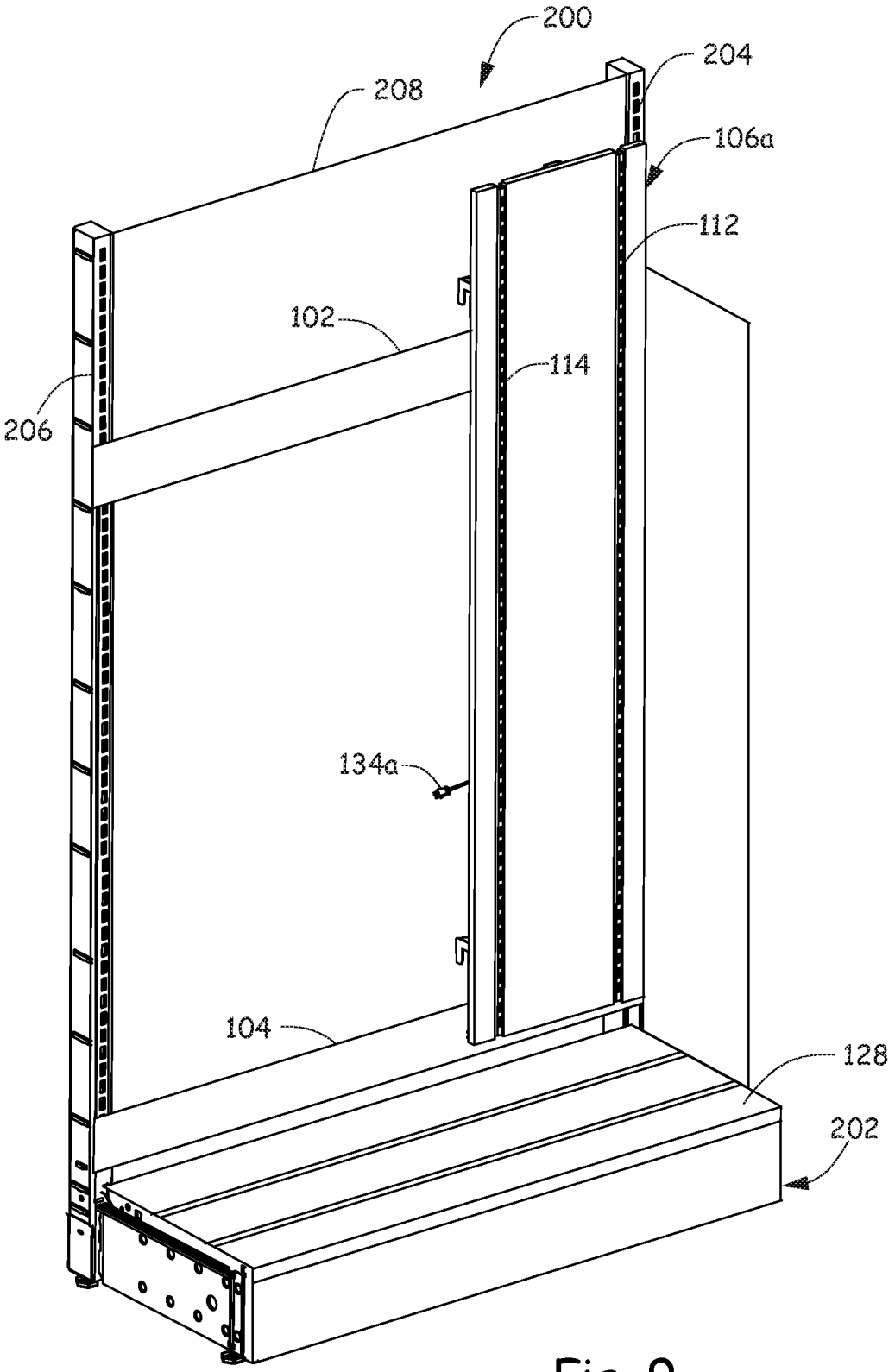
FIG. 9 is a perspective view of a fourth step in assembling the shelf assembly of FIG. 1.

Before mounting the fins and the powered back panels to cross bars 102 and 104, base deck sham 128 (FIGS. 1 and 2) is installed to cover top surface 203 of base deck 202. In FIG. 8, first fin 108*a* is hung on, mounted to or located on the right handed side of first cross bar 102 using hook 109*a* and on the right-handed side of second cross bar 104 using hook 109*b* as indicated by a directional arrow 129. As illustrated in FIG. 9, first powered back panel 106*a* is then hung on, mounted to or located on cross bars 102 and 104 adjacent to a left side of first fin 108*a* using hooks 107*a* and 107*b* similar to hooks 109*a* and 109*b* on first fin 108*a*. As illustrated, a pair of conductive uprights 112 and 114 of powered back panel 106*a* provide power for powering shelves 110*a-e*, which will be mounted to conductive uprights 112 and 114. In particular, powered back panel 106*a* includes a DC cord or wires 134*a* that protrude from a left side and are configured to be connected to a DC cord or wires of second powered back panel 106*b*. After first powered back panel 106*a* is in place, the continued alternating of fins and powered back panels are mounted to first and second cross bars 102 and 104 until all fins and powered back panels are hung.

Figure 10:
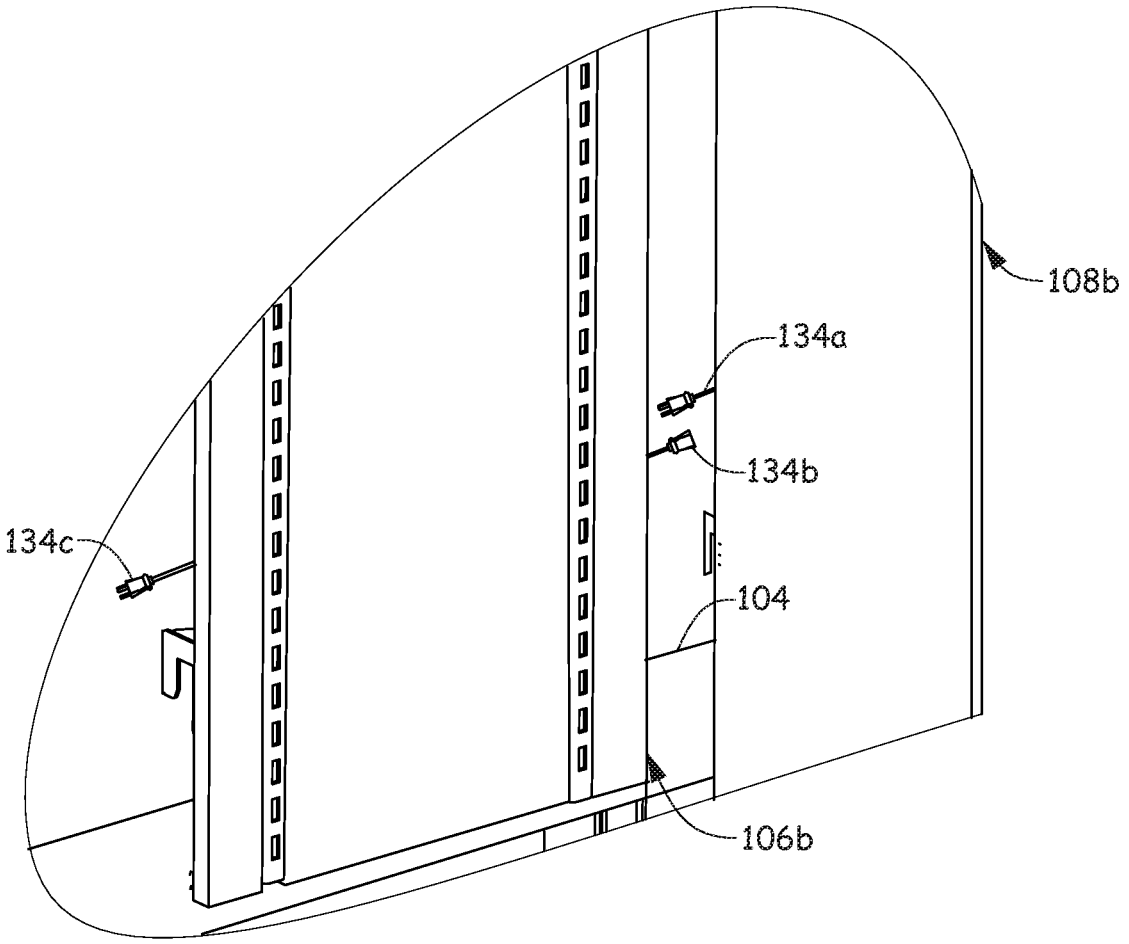
FIG. 10 is an enlarged perspective of further steps in assembling the shelf assembly of FIG. 1.

Second fin 108*b* is hung on, mounted to or located on first and second cross bars 102 and 104 in the same way that first fin 108*a* is hung on, mounted to or located on first and second cross bars 102 and 104. A right side of second fin 108*b* is located adjacent to a left side of first powered back panel 106*a*. In other words, second fin 108*b* is located adjacent to first powered back panel 106*a* on an opposing side of first powered back panel 106*a* from the location of first fin 108*a*. FIG. 10 is an enlarged perspective view of further steps in assembling shelf assembly 100. More specifically, second fin 108*b* is located in front of and allows DC cord or wires 134*a* to thread behind second fin 108*b* so that DC cord or wires 134*a* are available for connection to second powered back panel 106*b*. Before hanging, mounting or locating second powered back panel 106*b* to first and second cross bars 102 and 104, DC cord or wires 134*b* that protrude from a right side of second powered back panel 106*b* are electrically connected to DC cord or wires 134*a*. Then second powered back panel 106*b* is hung on, mounted to or located on first and second cross bars 102 and 104 using hooks with a right side of second powered back panel 106*b* being located adjacent to a left side of second fin 108*b*. In other words, second powered back panel 106*b* is located adjacent to second fin 108*b* on an opposing side of second fin 108*b* from first powered back panel 106*a*. Protruding from a left side of second powered back panel 106*b* are DC cord or wires 134*c* that are configured to be electrically coupled to DC cord or wires protruding from a right side of third powered back panel 106*c*.

Third fin 108*c* is hung on, mounted to or located on first and second cross bars 102 and 104 in the same way as second fin 108*b* and first fin 108*a*. A right side of third fin 108*c* is located adjacent to a left side of second powered back panel 106*b*. More specifically, third fin 108*c* is located in front of and allows DC cord or wires 134*c* to thread behind third fin 108*c* so that DC cord or wires 134*c* are available for connection to third powered back panel 106*c*. Before hanging, mounting or locating third powered back panel 106*c* to first and second cross bars 102 and 104, DC cord or wires that protrude from the right side of third powered back panel 106*c* are electrically connected to DC cord or wires 134*c* that protrude from second powered back panel 106*b*. Then third powered back panel 106*c* is hung on, mounted to or located on first and second cross bars 102 and 104 using hooks with a right side of third powered back panel 106*b* being located adjacent to a left side of third fin 108*c*. In other words, third powered back panel 106*c* is located adjacent to third fin 108*c* on an opposing side of third fin 108*c* from second powered back panel 106*b*. Protruding from left side of third powered back panel 106*c* are DC cord or wires that are configured to be electrically coupled to power supply 124 illustrated in FIG. 6, which is located under base deck 202 and behind base deck cover 203.

Figure 11:
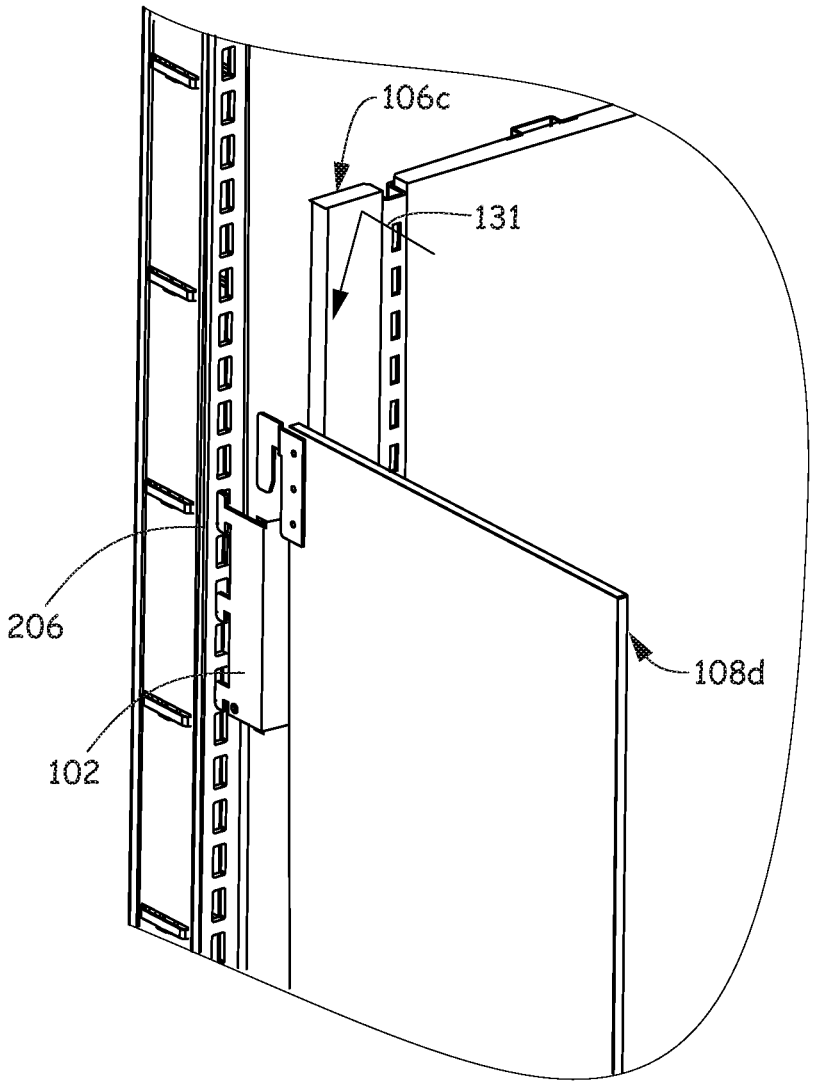
FIG. 11 is an enlarged perspective of another step in assembling the shelf assembly of FIG. 1.

FIG. 11 is an enlarged perspective of another step in assembling shelf assembly 100. Fourth fin 108*d* is hung on, mounted to or located on (as indicated by direction arrow 131) first and second cross bars 102 and 104 in the same way that third, second and first fins 108*c*, 108*b* and 108*a* were hung on, mounted to or located on first and second cross bars 102 and 104. A right side of fourth fin 108*d* is located adjacent to the left side of third powered back panel 106*c*. With all fins 108*a-d* and powered back panels 106*a-c* mounted to cross bars 102 and 104, the next step in assembling shelf assembly 100 is mounting or installing each shelf 110*a-o* with one of the powered back panels 106*a-c*.

In one embodiment, shelves 110*a-e* are mounted to and electrically coupled to the first pair of conductive uprights 112 and 114 in first powered back panel 106*a* located between first and second fins 108*a* and 108*b*, shelves 110*f-j* are mounted to and electrically coupled to the second pair conductive uprights 112 and 114 in second powered back panel 106*a* located between second and third fins 108*b* and 108*c* and shelves 110*k-o* are mounted to and electrically coupled to the third pair of conductive uprights 112 and 114 in third powered back panel 106*c*. Shelves 110*a-e* are vertically spaced apart from each other along the first pair of conductive uprights 112 and 114. Shelves 110*f-g* are vertically spaced apart from each other along the second pair of conductive uprights 112 and 114. Shelves 110*k-o* are vertically spaced apart from each other along the third pair of conductive uprights 112 and 114. In one embodiment, the vertical spacing is even so that shelves 110*a, f* and *k* are at the same height, shelves 110*b, g* and *l* are at the same height, shelves 110*c, h* and *m* are at the same height, shelves 110*d, i* and *n* are at the same height and shelves 110*e, j* and *o* are at the same height. Therefore, first fin 108*a*, first powered back panel 106*a*, second fin 108*b* and two of shelves 110*a-e* are configured to form a cuboid with an open front to display merchandise. Second fin 108*b*, second powered back panel 106*b*, third fin 108*c* and two of shelves 110*f-j* are configured to form a cuboid with an open front to display merchandise. Third fin 108*c*, third powered back panel 106*c*, fourth fin 108*d* and two of shelves 110*k-o* are configured to form a cuboid with an open front to display merchandise.

When shelves 110*a-o* are mounted to and electrically coupled to conductive uprights 112 and 114 in any of the powered back panels 106*a-c*, the plurality of lights of shelves 110*a-o*, as indicated by dashed illumination in FIGS. 3 and 4, are powered on. The plurality of lights on each shelf 110*a-o* are located on an underside 111*a-o* of a front end of each shelf. Therefore, the cuboids with open fronts are formed by any two fins 108*a-d*, any powered back panel 106*a-c* and two shelves 110*a-o* mounted to the same powered back panel are lit by the plurality of lights on the uppermost shelf of the two shelves.

To finish the assembling of shelf assembly 100, right and left side trim pieces 136 (the left side trim piece is not shown in the figures but is a mirror image of the right side trim piece) are hung on or attached to right and left ends of cross bars 102 and 104, respectively. In addition, header or topper 138 is installed on or attached to the tops of powered back panels 106*a* and 106*c* using prongs 140 and 141 as illustrated in FIG. 2.

Figure 12:
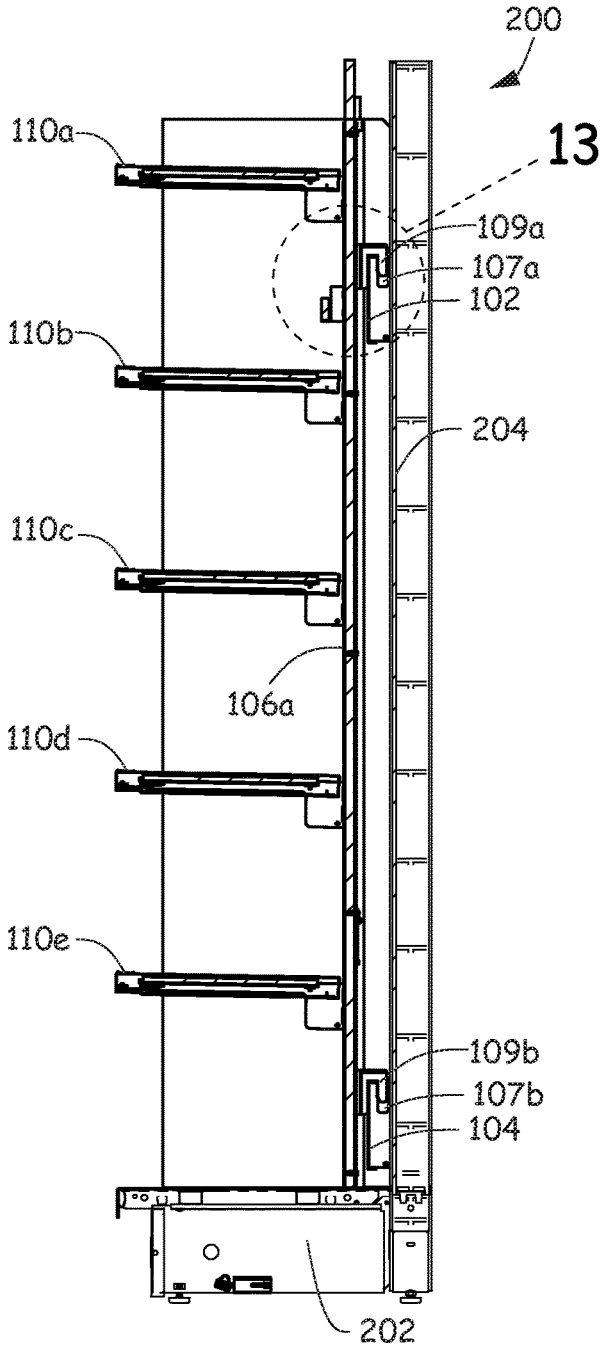
FIG. 12 is a section view of the shelf assembly of FIG. 1 as taken through the line indicated in FIG. 3.
Figure 13:
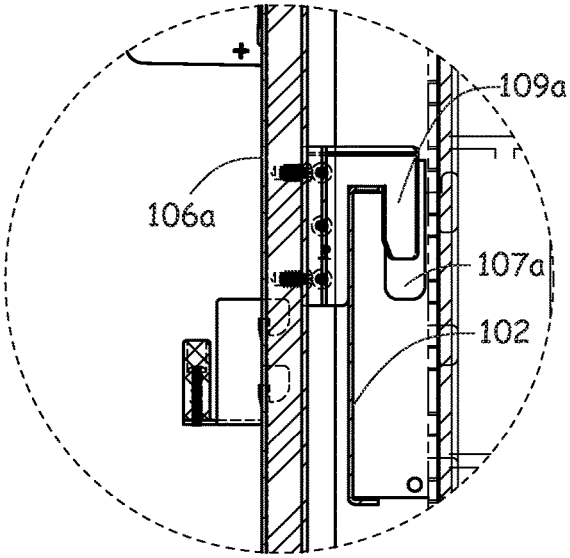
FIG. 13 is an enlarged detailed view of a portion of the section view of the shelf assembly in FIG. 12.

FIG. 12 is a section view of shelf assembly 100 as taken through the line indicated in FIG. 3. FIG. 13 is an enlarged detailed view of a portion of the section view of shelf assembly 100 in FIG. 12.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A shelf assembly comprising:

a plurality of fins;

a plurality of powered back panels each having a pair of conductive uprights that are vertically oriented and horizontally spaced apart from each other, each powered back panel being located between two of the plurality of fins and being electrically coupled to another of the plurality of powered back panels;

a plurality of shelves each mounted to and electrically coupled to the pair of conductive uprights of one of the powered back panels and configured to power a plurality of lights located on each shelf based on the electrical coupling of each shelf to the pair of conductive uprights; and at least one cross bar mounted to a pair of uprights of a gondola and configured to receive and support the plurality of fins and the plurality of powered back panels; and wherein two of the plurality of shelves mounted to the same pair of conductive uprights of the same powered back panel and two of the plurality of fins located on either side of that same powered back panel are configured to form a cuboid with an open front to display merchandise.

2. The shelf assembly of claim 1, wherein the at least one cross bar comprises first and a second cross bars mounted horizontally to the pair of uprights of the gondola.

3. The shelf assembly of claim 1, wherein the plurality of fins and the plurality of powered back panels are mounted to the at least one cross bar with hooks.

4. The shelf assembly of claim 1, further comprising a base deck sham configured to cover a base deck of the gondola.

5. The shelf assembly of claim 1, further comprising a pair of trim pieces located on each of a right side and a left side of the shelf assembly to cover right sides and left sides of the at least one cross bar.

6. The shelf assembly of claim 1, wherein the plurality of lights located on each shelf are located on an underside of a front end of each shelf.

7. The shelf assembly of claim 1, further comprising a header configured to mate with top ends of at least one of the plurality of powered back panels.

8. A shelf assembly comprising:

at least one cross bar configured to be mounted to a pair of uprights on a gondola;

a first fin mounted to the at least one cross bar;

a first powered back panel mounted to the at least one cross bar and located adjacent to the first fin, the first powered back panel having a first pair of conductive uprights that are vertically oriented and horizontally spaced apart from each other;

a second fin mounted to the at least one cross bar and located adjacent to the first powered back panel on an opposing side of the first powered back panel from the location of the first fin; and at least two shelves mounted to and electrically coupled to the first pair of conductive uprights of the first powered back panel, are vertically spaced apart from each other along the first pair of conductive uprights and are configured to power a plurality of lights located on the at least two shelves based on the electrical coupling of the at least two shelves to the first pair of conductive uprights; and wherein the first fin, the first powered back panel, the second fin and the at least two shelves mounted to the first powered back panel are configured to form a cuboid with an open front to display merchandise.

9. The shelf assembly of claim 8, wherein the at least one cross bar comprises an upper cross bar mounted to an upper portion of the pair of uprights on the gondola and a lower cross bar mounted to a lower portion of the pair of uprights on the gondola.

10. The shelf assembly of claim 8, wherein the first fin, the first powered back panel and the second fin are mounted to the at least one cross bar with hooks.

11. The shelf assembly of claim 8, wherein the plurality of lights located on the at least two shelves that are mounted to the first powered back panel are located on an underside of a front end of each shelf, wherein the cuboid with the open front formed by the first fin, the first powered back panel, the second fin and the at least two shelves mounted to the first powered back panel is lit by the plurality of lights on an uppermost shelf of the at least two shelves mounted to the first powered back panel.

12. The shelf assembly of claim 8, further comprising:

a second powered back panel mounted to the at least one cross bar and located adjacent to the second fin on an opposing side of the second fin from the first powered back panel, the second powered back panel having a second pair of conductive uprights that are vertically oriented and horizontally spaced apart from each other;

a third fin mounted to the at least one cross bar and located adjacent to the second powered back panel; and at least two shelves mounted to and electrically coupled to the pair of second conductive uprights of the second powered back panel, are vertically spaced apart from each other along the second pair of conductive uprights and are configured to power a plurality of lights located on the at least two shelves based on the electrical coupling of the at least two shelves to the second pair of conductive uprights; and wherein the second fin, the second powered back panel, the third fin and the at least two shelves mounted to the second powered back panel are configured to form a cuboid having an open front to display merchandise.

13. The shelf assembly of claim 12, wherein the third fin and the second powered back panel are mounted to the at least one cross bar with hooks.

14. The shelf assembly of claim 12, wherein the plurality of lights located on the at least two shelves that are mounted to the second powered back panel are located on an underside of a front end of each shelf, wherein the cuboid with the open front is formed by the second fin, the second powered back panel, the third fin and the at least two shelves mounted to the second powered back panel is lit by the plurality of lights on an uppermost shelf of the at least two shelves mounted to the second powered back panel.

15. The shelf assembly of claim 13, further comprising:

a third powered back panel mounted to the at least one cross bar and located adjacent to the third fin on an opposing side of the third fin from the second powered back panel, the third powered back panel having a third pair of conductive uprights that are vertically oriented and horizontally spaced apart from each other;

a fourth fin mounted to the at least one cross bar and located adjacent to the third powered back panel; and at least two shelves mounted to and electrically coupled to the third pair of conductive uprights of the third powered back panel, are vertically spaced apart from each other along the third pair of conductive uprights and are configured to power a plurality of lights located on the at least two shelves based on the electrical coupling of the at least two shelves to the third pair of conductive uprights; and wherein the third fin, the third powered back panel, the fourth fin and the at least two shelves mounted to the third powered back panel are configured to form a cuboid with an open front to display merchandise.

16. The shelf assembly of claim 15, wherein the fourth fin and the third powered back panel are mounted to the at least one cross bar with hooks.

17. The shelf assembly of claim 15, wherein the plurality of lights located on the at least two shelves that are mounted to the third powered back panel are located on an underside of a front end of each shelf, wherein the cuboid formed by the third fin, the third powered back panel, the fourth fin and the at least two shelves mounted to the third powered back panel is lit by the plurality of lights on an uppermost shelf of the at least two shelves mounted to the third powered back panel.

18. A method of assembling a shelf assembly comprising:

mounting at least one cross bar to a pair of uprights on a gondola;

mounting a first fin to the at least one cross bar;

mounting a first powered back panel to the at least one cross bar and locating the first powered back panel adjacent to the first fin, the first powered back panel having a first pair of conductive uprights that are vertically oriented and horizontally spaced apart from each other;

mounting a second fin to the at least one cross bar and locating the first powered back panel adjacent to an opposing side of the first powered back panel from the location of the first fin; and mounting and electrically coupling at least two shelves to the first pair of conductive uprights of the first powered back panel by vertically spacing each along the first pair of conductive uprights and powering a plurality of lights located on the at least two shelves based on the electrical coupling of the at least two shelves to the first pair of conductive uprights; and wherein the first fin, the first powered back panel, the second fin and the at least two shelves mounted to the first powered back panel are configured to form a cuboid with an open front to display merchandise.

19. The shelf assembly of claim 18, further comprising:

mounting a second powered back panel mounted to the at least one cross bar and locating the second powered back panel adjacent to the second fin on an opposing side of the second fin from the first powered back panel, the second powered back panel having a second pair of conductive uprights that are vertically oriented and horizontally spaced apart from each other;

mounting a third fin to the at least one cross bar and locating the third fin adjacent to the second powered back panel; and mounting and electrically coupling at least two shelves to the pair of second conductive uprights of the second powered back panel by vertically spacing each along the second pair of conductive uprights and powering a plurality of lights located on the at least two shelves based on the electrical coupling of the at least two shelves to the second pair of conductive uprights; and wherein the second fin, the second powered back panel, the third fin and the at least two shelves mounted to the second powered back panel are configured to form a cuboid with an open front to display merchandise.

20. The shelf assembly of claim 19, further comprising:

mounting a third powered back panel to the at least one cross bar and locating the third powered back panel adjacent to the third fin on an opposing side of the third fin from the second powered back panel, the third powered back panel having a third pair of conductive uprights that are vertically oriented and horizontally spaced apart from each other;

mounting a fourth fin to the at least one cross bar and locating the fourth fin adjacent to the third powered back panel; and mounting and electrically coupling at least two shelves to the third pair of conductive uprights of the third powered back panel by vertically spacing each along the third pair of conductive uprights and powering a plurality of lights located on the at least two shelves based on the electrical coupling of the at least two shelves to the third pair of conductive uprights; and wherein the third fin, the third powered back panel, the fourth fin and the at least two shelves mounted to the third powered back panel are configured to form a cuboid with an open front to display merchandise.

* * * * *